United States Patent [19]

Nakaniwa et al.

[11] Patent Number: 4,831,987

[45] Date of Patent: May 23, 1989

[54] SETTING DEVICE OF BASIC FUEL INJECTION AMOUNT FOR AN INTERNAL COMBUSTION ENGINE

[75] Inventors: Shinpei Nakaniwa, Maebashi; Yukio Hoshino, Gunma; Naoki Tomisawa, Takasaki; Seiichi Otani, Maebashi; Tadashi Ariga; Shouji Furuhashi, both of Yokohama, all of Japan

[73] Assignees: Nissan Motor Co., Ltd., Yokohama; Nippon Denshi Kiki Co., Ltd., Isezaki, both of Japan

[21] Appl. No.: 89,784

[22] Filed: Aug. 27, 1987

[30] Foreign Application Priority Data

Aug. 27, 1986 [JP] Japan ..... 61-199135

[51] Int. Cl.[4] ..... F02D 41/10

[52] U.S. Cl. ..... 123/488; 123/492

[58] Field of Search ..... 123/478, 492, 493, 488, 123/494

[56] References Cited

U.S. PATENT DOCUMENTS 4,528,964 7/1985 Kashiwaya et al. ..... 123/492

4,636,957 1/1987 Otobe et al. ..... 123/492 X

FOREIGN PATENT DOCUMENTS 203828 11/1984 Japan .

*Primary Examiner*—Tony M. Argenbright

*Attorney, Agent, or Firm*—Foley & Lardner, Schwartz, Jeffery, Schwaab, Mack, Blumenthal & Evans

[57] ABSTRACT

A setting device of basic fuel injection amount for an internal combustion engine in an operating region of acceleration comparing a detected amount of intake airflow with a retrieved amount of intake airflow stored with the area of opening of a throttle valve and the engine velocity used as parameter, and when the detected amount is less than the retrieved amount, modifying the detected amount on the basis of the change ratio of opening area in the throttle valve, the engine load and the engine velocity, thereby modifying the detected amount so that it is close to the amount required by the engine.

10 Claims, 6 Drawing Sheets

SETTING DEVICE OF BASIC FUEL INJECTION AMOUNT FOR AN INTERNAL COMBUSTION ENGINE

BACKGROUND OF THE INVENTION

1. Field of the Invention

The present invention relates to a fuel injection apparatus for an internal combustion engine, and more specifically to a setting device of basic fuel injection amount for an internal combustion engine.

2. Description of the Related Art

An example of a conventional electronically controlled setting device of fuel injection amount for an internal combustion engine is given in Japanese Patent Publication of Unexamined Application No. SHO-59-203828 in which the operation of a fuel injection valve is controlled based on the basic amount of fuel injection preset corresponding to the operating status of the engine, specifically, on the amount of fuel injected corresponding to the amount of intake air for one revolution of the engine.

In this conventional device, the basic amount of injected fuel Tp ($=K\times Q/N$, where K is a constant) is calculated from the amount Q of intake airflow detected by an airflow meter and the engine velocity N detected by an ignition signal etc. After calculation of the various revision coefficients (COEF) corresponding to the engine operating status determined from the cooling water temperature and so on, the revision coefficient $\alpha$ from the feedback of the air/fuel ratio, and the revised portion Ts from the battery voltage, the amount of Ti of fuel injected is calculated according to the equation:

$$Ti=Tp\times COEF\times\alpha+Ts$$

Then an injection pulse signal of the pulse width corresponding to the calculated amount Ti of fuel injection is output, so that the prescribed amount of fuel is injected into the engine.

In addition, the ignition timing of the spark plug is calculated from the basic amount Tp of fuel injection calculated and the engine velocity N.

Incidentally, one problem with the above-mentioned conventional electronically controlled fuel injection device for an internal combustion engine is that, as shown in FIG. 7, in the fuel injection during the initial stage of the acceleration of the engine, an amount of intake air detected by the airflow meter is inclined to be smaller than the amount of air actually taken into the cylinder because of the delay in response of the detected amount of intake airflow and the delay in calculation by the control device. If the basic amount of fuel injection is preset based on this detected amount of intake airflow, the basic amount of fuel injection preset is smaller than the amount actually required by the engine, causing an overleaning of the air/fuel ratio. On the other hand, in the final stage of the acceleration, an amount of intake air detected is larger than the actual amount of intake air because the amount of air detected by the airflow meter includes the portion of the air which fills the intake manifold, specifically, the amount of air which fills the intake manifold and does not enter the cylinder, and consequently the air/fuel ratio becomes overrich.

Then, in the initial acceleration period, an amount of fuel injected into the engine is inclined to be smaller than that required by the engine, which causes an overlean air/fuel ratio. This causes the problems of acceleration shock, worsening of the situation of the exhaust gases (an increase in the discharge of nitrogen oxides, NOx), the occurrence of knocking and so on.

SUMMARY OF THE INVENTION

An object of the present invention is to provide, with due consideration of the drawbacks of such conventional devices, a setting device of fuel injection amount for an internal combustion engine wherein the basic amount of fuel injection is precisely set to correspond to the actual amount of intake airflow, thereby preventing the overleaning of the air/fuel ratio during the initial stage of acceleration.

Another object of the present invention is to provide a setting device of fuel injection amount for an internal combustion engine wherein, if an error occurs in the intake airflow detection means during acceleration of the engine, the detected amount of intake airflow is modified according to the engine load, the change ratio of opening area in the throttle valve and the velocity of the engine, so that it is close to the actual value.

A further object of the present invention is to provide a setting device of fuel injection amount for an internal combustion engine wherein a judgment is made according to the change ratio of opening area in the throttle valve as to whether the acceleration of the engine is fast acceleration or slow acceleration, and a judgment is also made from the area of opening in the throttle valve and the engine velocity as to the error trend of the detected amount of the intake airflow in relation to the actual value, including the delay in calculating, whereby, the detected value is modified, so that it is close to the actual value.

A still further object of the present invention is to provide a setting device of feul injection amount for an internal combustion engine wherein the basic amount of fuel injection is set corresponding to the actual amount of intake airflow, whereby the air/fuel ratio is controlled to a desired value, and in addition, the ignition timing can be set to correspond to the amount of air which is actually taken into the cylinder.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1:
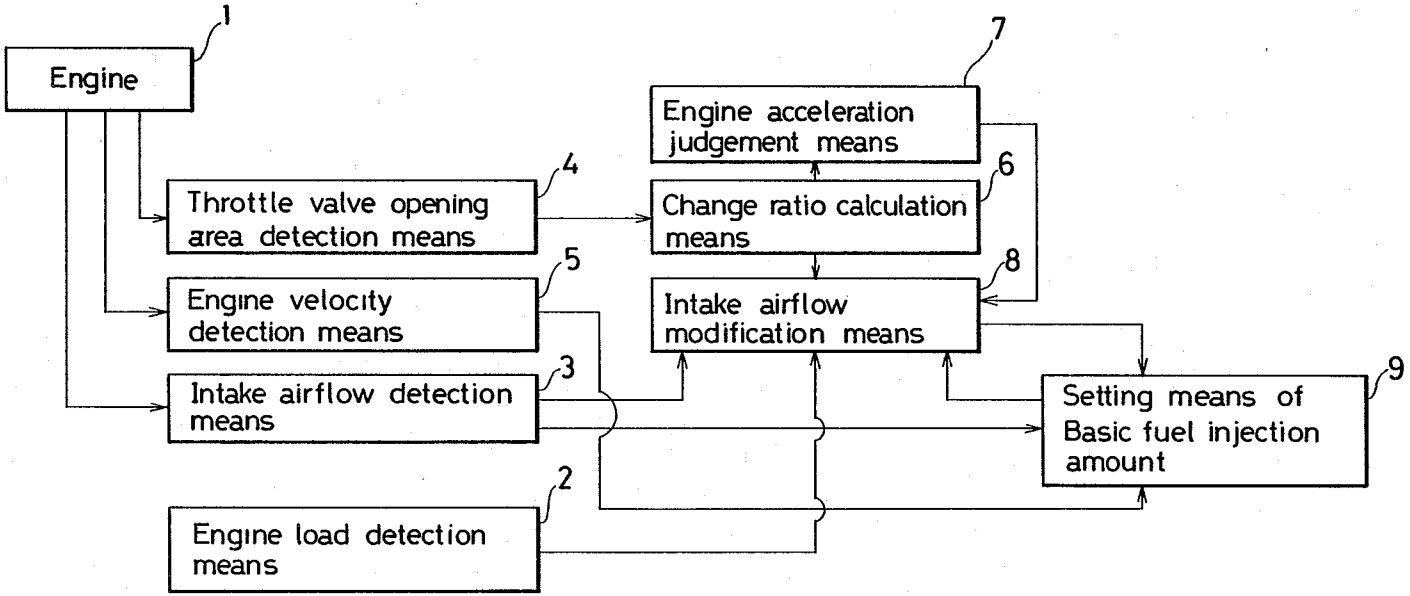
FIG. 1 is a block diagram showing a basic construction of the present invention.

Now referring to FIG. 1, the setting device of basic fuel injection amount for a internal combustion engine 1 of the present invention comprises an engine load detection means 2 which detects the engine load; an intake airflow detection means 3 which detects the amount of intake airflow for the internal combustion engine; a throttle valve opening detection means 4 which detects the area of opening of a throttle valve; an engine velocity detection means 5 which detects the velocity of the engine; a change ratio calculation means 6 which calculates the ratio of change in opening area of the throttle valve, based on the area of opening of the throttle valve which is detected by the throttle valve opening detection means 4; an engine acceleration judgment means 7 which judges or determines that the engine is accelerating when the change ratio of opening area of the throttle valve calculated by the change ratio calculation means 6 equals or exceeds a predetermined value toward its open position; an intake airflow modification means 8 which modifies the amount of intake airflow of the internal combustion engine detected by the intake airflow detection means 3 based on the engine load, the change ratio of opening area in the throttle valve and the engine velocity, only when the engine is judged to be accelerating by the engine acceleration judgment means 7; and a setting means of basic fuel injection amount 9 which presets the basic amount of fuel injection, based on the detected value of the engine velocity as well as one of the amount of intake airflow detected by the intake airflow amount detection means 3 and the amount of intake airflow modified by the intake airflow modification means 8.

Figure 2:
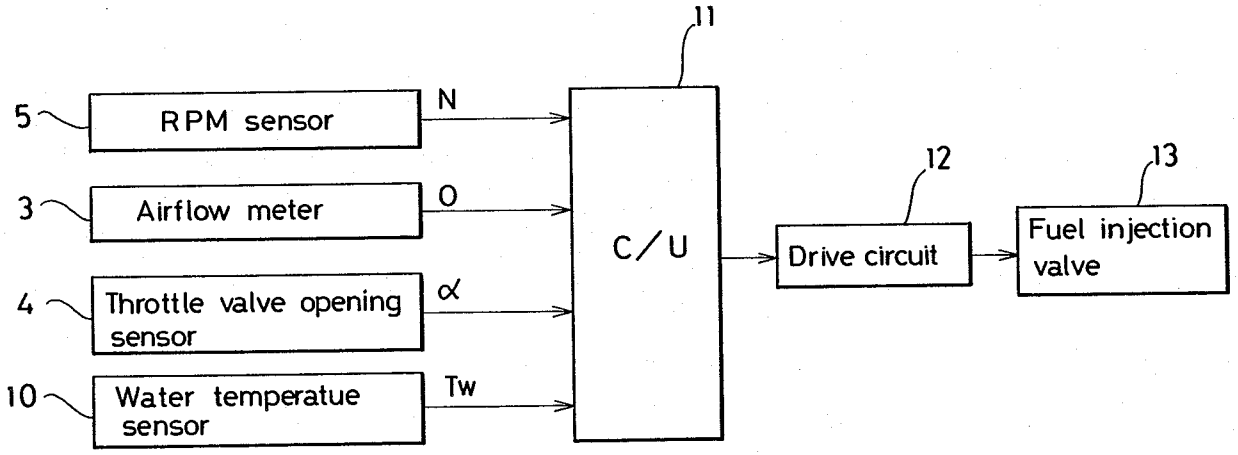
FIG. 2 is a block diagram showing an embodiment of the setting device of basic fuel injection amount for an internal combustion engine of the present invention.

In FIG. 2, the hardware configuration for an electronically controlled fuel injection device provided with the setting device of basic fuel injection amount for an internal combustion engine of the present invention is shown.

In this drawing, a RPM sensor 5 is used as the means of detecting the velocity of the engine. The output from the RPM sensor 5 is an engine velocity signal N. An airflow meter 3 is used as a means for detecting the amount of intake airflow. The output from the airflow meter 3 is an intake airflow amount signal Q. A throttle valve opening sensor 4 which is positioned in the air intake channel of the engine is used as a means for detecting the area of opening of the throttle valve (omitted from the drawings). The output of the throttle valve opening sensor 4 is a valve opening area signal $\alpha$. An engine cooling water temperature signal Tw is the output from a water temperature sensor 10. These signals are input to a control unit 11 which has a microcomputer built therein, which comprises an I/O device, a memory device and a CPU device. The control unit 11 outputs an injection pulse signal (for which the setting is hereinafter described) to a drive circuit 12 of a fuel injection valve 13, based on the signals mentioned above.

Specifically, in this embodiment of the present invention, the control unit 11 comprises, through the software, a change ratio calculation means for the area of opening of the throttle valve, an engine acceleration judgment means, an intake airflow modification means, and a setting means of basic fuel injection amount.

Figure 3:
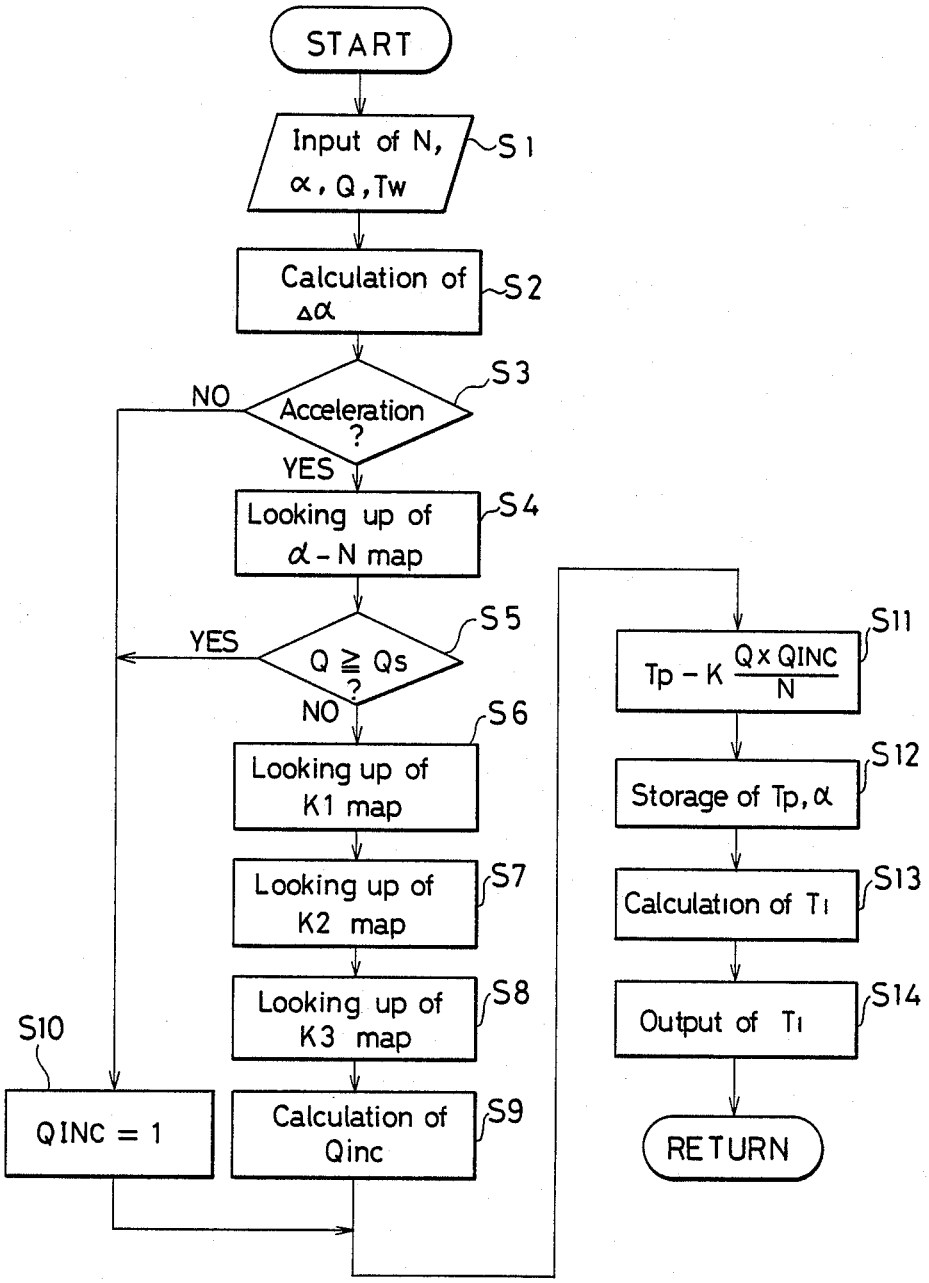
FIG. 3 is a flowchart showing the control of the fuel injection in the embodiment of the present invention of FIG. 2.

Next, the operation of an embodiment of the present invention will be described, based on the flowchart of FIG. 3.

At Step S1, the engine velocity N, the amount Q of intake airflow, the area $\alpha$ of opening of throttle valve, and the cooling water temperature Tw are input, having been detected by means of the respective sensors.

Further, in this embodiment, the basic amount Tp of fuel injection is used to represent the engine load, which means that the engine velocity sensor 5 and the airflow meter 3 jointly correspond to the engine load detection means 2. Incidentally, the engine load which is represented by the basic amount Tp of fuel injection in this embodiment can also be represented by intake negative pressure, engine torque, average effective pressure in graphic representation etc.

At Step S2, a change ratio $\Delta\alpha$ of opening area in the throttle valve is calculated based on the area $\alpha$ of opening of the throttle valve input in the Step S1, and a value detected and recorded in Step S12 in the previous operation or round.

In Step S3, a decision is made as to whether the engine is accelerating or not, based on the change ratio $\Delta\alpha$ of opening area calculated in Step S2. Specifically, when the change ratio $\Delta\alpha$ of opening area calculated in Step S2 equals or exceeds a predetermined level toward its opening position, the engine is judged to be accelerating, and the program advances to the Step S4. If the engine is judged not to be accelerating, the program proceeds to Step S10 and the increasing modification coefficient $Q_{inc}$ of intake airflow amount is set to 1.

At Step S4, referring to in each of a plurality of operating regions, previously recorded data on the amount of intake airflow with the area $\alpha$ of opening of the throttle valve and the engine velocity N as parameters, the amount of intake airflow Qs for a particular operating region is retrieved based on the detected area $\alpha$ of opening of the throttle valve and the engine velocity N detected in the operating region and input in the Step S1. Here, the amount Qs of intake airflow is a value obtained from a previous test, and is a value very close to the actual amount of intake airflow, that is, to the amount of intake airflow required by the engine. However the amount Qs cannot accommodate the change in air density, and because a portion of the air which is fed bypassing the throttle valve is not included, it is difficult to state that this amount Qs is the true value, but it can still be used as a simple standard for the control line.

In Steps S5, the amount Qs of intake airflow retrieved in Step 4 and the detected amount Q of the intake airflow input in Step 1 are compared. When the detected amount Q is equal to or greater than the retrieved amount Qs ($Q \geqq Qs$), the program proceeds to Step S10. When the detected amount Q is less than the retrieved amount Qs ($Q < Qs$), the program proceeds to Step S6. This is to find an operating region where the amount of intake air detected by the airflowmeter 2 during acceleration of the engine is smaller than the actual amount of intake airflow, thereby modifying the detected amount of intake airflow to prevent overleaning. Incidentally, in the final stage of the acceleration in which the amount of intake air detected by the airflow meter 2 is greater than the actual amount of intake airflow, an over-rich air/fuel ratio is produced but does not cause an acceleration shock to be created. Of course, in order to prevent the occurrence of an over-rich mixture, it is also acceptable to calculate a modified amount for the amount of intake airflow in an operating area where $Q<Qs$, which is set forth in Japanese Patent Application No. 61-199137, corresponding to U.S. Ser. No. 089,788 filed Aug. 27, 1987.

Figure 4:
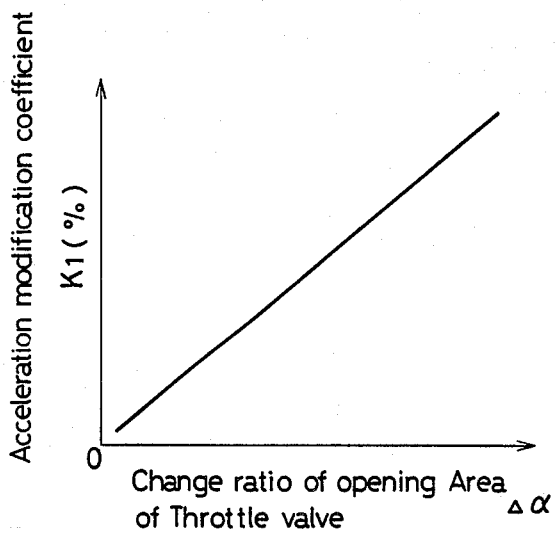
FIG. 4 is a graph showing an acceleration modification coefficient K1, which is of the modification coefficients for the amount of intake airflow in the embodiment of the present invention of FIG. 2.

In Step S6, a map of an acceleration modification coefficient K1 for obtaining an increasing modification coefficient $Q_{inc}$ for increasing the amount of intake airflow is referenced, and the acceleration modification coefficient K1 for this round is retrieved. Here, the acceleration modification coefficient K1 is preset to correspond to the change ratio $\Delta\alpha$ of opening area in the throttle valve, and in Step S2, it is retrieved based on the $\Delta\alpha$ calculated. This acceleration modification coefficient K1, as shown in FIG. 4, is preset in proportion to the change $\Delta\alpha$ of opening area in the throttle valve. Accordingly, the amount of increasing modification is made greater during an rapid acceleration where the amount of intake airflow rapidly changes.

Figure 5:
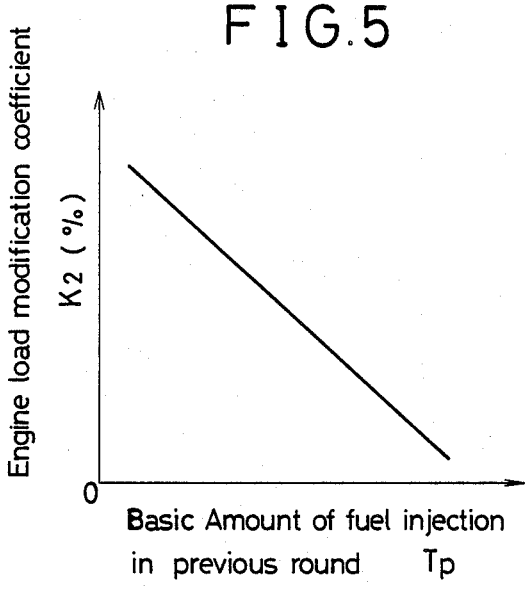
FIG. 5 is a graph showing an engine load modification coefficient K2, which is another of the modification coefficients for the amount of intake airflow in the embodiment of the present invention of FIG. 2.
Figure 6:
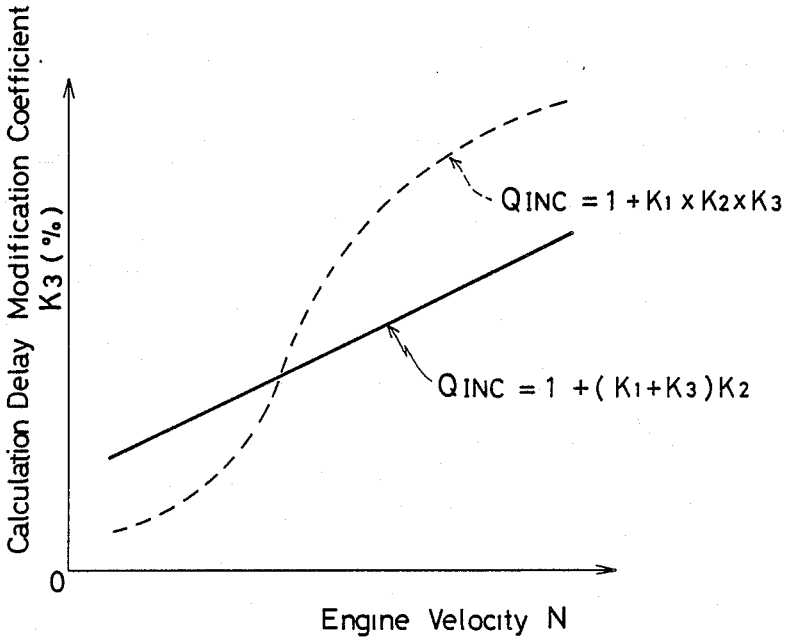
FIG. 6 is a graph showing a calculation delay modification coefficient K3, which is another of the modification coefficients for the amount of intake airflow in the embodiment of the present invention of FIG. 2.

In Step S7, based on the basic amount Tp of fuel injection which is representative of the engine load and which was recorded in the previous Step S12, the map of an engine load modification coefficient K2 is referenced and the engine load modification constant K2 for this round is retrieved. This engine load modification constat K2, as shown in FIG. 5, is set inversely proportional to the basic amount Tp of fuel injection of the previous round, and, in this way, the quantity of increasing modification becomes greater in the first stage of the engine acceleration.

In Step S8, based on the engine velocity input in the Step S1, the map of a calculation delay modification coefficient K3 is referenced and a calculation delay modification coefficient K3 for this round is retrieved. This calculation delay modification coefficient K3 is preset almost proportional to the engine velocity N, and its value is changed by calculating the increasing modification coefficient $Q_{inc}$, which will be later explained.

In Step S9, by means of the modification coefficients K1, K2, and K3, which were retrieved and set in Steps S6 to S8, the increasing modification coefficient $Q_{inc}$ for the amount of intake airflow is calculated according to the equations: $Q_{inc}=1+K2(K1+K3)$ or $Q_{inc}=1+K1\times K2\times K3$. Further, it is also satisfactory to obtain the increasing modification coefficient $Q_{inc}$ by the equation: $Q_{inc}=1+K1\times K2$, in which the coefficient K3 is not used.

Figure 7:
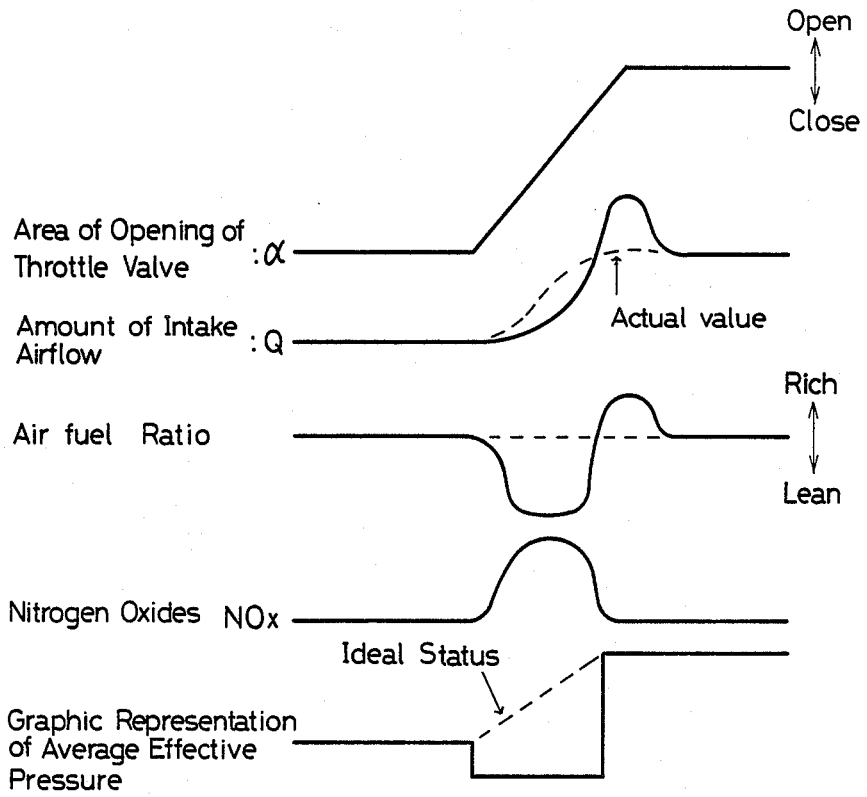
FIG. 7 PRIOR ART
FIG. 7 is a timing chart illustrating the problems of conventional control devices.

In Step S11, the basic amount Tp of fuel injection is calculated ($Tp=K\times Q\times Q_{inc}/N$), based on the increasing modification coefficient $Q_{inc}$ obtained by calculation in the Step S9, or on the increasing modificaton coefficient $Q_{inc}$ which was preset to 1 in Step S10. Accordingly, when the increasing modification coefficient $Q_{inc}$ is preset to 1, specifically, when the engine is not accelerating (the Step S3), or when the detected amount Q of intake airflow is equal to or greater than the retrieved value Qs, the increasing modification of the amount Q of intake airflow is not carried out, and the basic amount Tp of fuel injection is calculated based on the amount Q of intake airflow which was input in the Step S1 and the engine velocity N. On the other hand, in a region in which an amount of intake airflow detected by the airflow meter 3 for the initial stage of the acceleration is less than the actual amount of intake airflow (see FIG. 7), each of the previously discussed modification coefficients K1, K2, and K3 obtained and preset by previous testing is used, and the detected value Q is modified as close to the actual amount of intake airflow as possible by multiplying the value Q detected by the airflow meter 3 and the calculated increasing modification coefficient $Q_{inc}$.

In this way, it is possible by modification of the detected value Q using the calculation ($Q\times Q_{inc}$) to obtain a value close to the actual amount of the intake airflow in the initial stage of engine acceleration where the detected amount of intake airflow from the airflow meter 3 is inclined to be smaller than the actual amount of intake airflow, so that the basic amount Tp of fuel injection can be set to precisely correspond to the actual amount of intake airflow. Accordingly, there is no overleaning of the air/fuel ratio, and acceleration shock and worsening of the condition of the exhaust gases and the like can be prevented.

In Step S12, the basic amount Tp of fuel injection calculated in Step S11 and the area $\alpha$ of opening of the throttle valve input in the Step S1 are stored or recorded. These respective values are used in Step S2 and Step S7 of the next round or operation.

In Step S13, modification coefficients based on the respective operating conditions which are recorded and preset in the memory device are retrieved for each type of operating condition, such as the temperature Tw of the engine cooling water detected by the water temperature sensor 10. These modification coefficients are calculated in the CPU to obtain the various revision coefficients COEF, which are incorporated in order that the previously mentioned basic amount Tp of fuel injection is modified to obtain an amount Ti of fuel injection.

In Step S14, a fuel injection pulse signal, with a pulse width corresponding to the amount Ti of fuel injection which was set in the Step S13, is output to the drive circuit 12 of the fuel injection valve 13.

Further, in the case where the ignition timing is determined according to the basic amount Tp of fuel injection and the engine velocity N, the knocking, which would otherwise readily develop in the initial stages of acceleration, can be prevented by a setting device of basic fuel injection amount for an internal combustion engine such as shown in this embodiment, because it is possible to set the ignition timing to precisely correspond to the amount of air actually taken into the cylinder, eliminating effects of delay in response and calculation, although this is not limited to the above-mentioned embodiment.

In summary, even when the intake airflow detection means detects an amount which is smaller than the actual amount of intake airflow because of a response delay and a calculation delay in determining the amount of intake airflow in the initial stages of acceleration, this detected value is modified by means of the present invention, so that this detected value is made very close to the actual amount of intake airflow. Accordingly, the basic amount of fuel injection can be set to precisely correspond to the required amount for the engine.

For this reason, overleaning of the air/fuel ratio is prevented in the initial stage of engine acceleration, with the result that it is possible to prevent the development of acceleration shock, worsening of the exhaust conditions, knocking, and the like.

What is claimed is:

1. A setting device of basic fuel injectin amount for an internal combustion engine in an operating region of acceleration comprising:

an engine load detection means which detects an engine load;

an intake airflow detection means for detecting an amount of intake airflow of the engine, a throttle valve opening detection means for detecting an area of opening of a throttle valve interposed in an intake air channel of the engine, an engine velocity detection means for detecting a velocity of the engine;

a change ratio calculation means which calculates a ratio of change in the opening area of the throttle valve, based on the detected area of opening of the throttle valve;

an engine acceleration judgment means which judges that the engine is accelerating when the calculated ratio of change in the opening area of the throttle valve equals or exceeds a predetermined value toward its open position;

an intake airflow modification means which modifies the detected amount of intake airflow based on the change ratio of opening area in the throttle valve, the engine load, and the engine velocity, only when the engine is judged to be at acceleration status;

and a setting means of basic fuel injection amount which sets the basic amount of fuel injection, based on the detected value of the engine velocity and one of the detected amount of intake airflow and the modified amount of intake airflow.

2. The setting device of claim 1, wherein the engine load is determined by the engine velocity and the amount of intake airflow.

3. A method of setting a basic fuel injection amount for an internal combustion engine operated in a region of acceleration comprising the steps of:

detecting the acceleration of the engine;

detecting an amount of intake airflow of the engine;

retrieving data of intake airflow amounts preset in the operating region based on the area of opening of a throttle valve interposed in an intake air channel of the engine and a velocity of the engine to obtain a retrieved amount of intake airflow;

modifying the detected amount of intake airflow when the detected amount of intake airflow is less than the retrieved amount of intake airflow, so that the detected amount of airflow is increased to precisely correspond to the amount of intake airflow required by the engine in the operation region.

4. The method of setting a basic fuel injection amount for an internal combustion engine of claim 3 wherein the step of increasing the intake airflow amount is carried out based on an acceleration modification coefficient, which is preset in proportion to the change ratio of opening area of the throttle valve, and based on an engine load modification coefficient, which is preset in inverse proportion to a basic fuel injection amount based on the amount of intake airflow and the engine velocity.

5. The method of setting a basic fuel injection amount for an internal combustion engine of claim 4 wherein the step of increasing the intake airflow amount is carried out further based on a calculation delay coefficient which is preset in proportion to the engine velocity.

6. The method of setting a basic fuel injection amount for an internal combustion engine of claim 3, wherein the step of detecting the engine acceleration is made by judging that engine is accelerating when the change ratio of area of opening in the throttle valve equals or exceeds a predetermined value.

7. The method of setting a basic fuel injection amount for an internal combustion engine of claim 4, wherein the step of detecting the engine acceleration is made by judging that engine is accelerating when the change ratio of area of opening in the throttle valve equals or exceeds a predetermined value.

8. The method of setting a basic fuel injection amount for an internal combustion engine of claim 5, wherein the step of detecting the engine acceleration is made by judging that engine is accelerating when the change ratio of area of opening in the throttle valve equals or exceeds a predetermined value.

9. A setting device of basic fuel injection amount for an internal combustion engine in an operating region of acceleration comprising:

an engine load detection means which detects an engine load;

an intake airflow detection means for detecting an amount of intake airflow of said engine in said operating region, a throttle valve opening detection means for detecting an area of oening of a throttle valve interposed in an intake air channel of said engine, an engine velocity detection means for detecting a velocity of said engine;

a change ratio calculation means which calculates a ratio of change in said opening area of said throttle valve, based on said detected area of opening of said throttle valve;

a means for storing required amounts of intake airflow on the basis of previously detected areas of opening of said throttle valve of said engine and previously detected velocities of said engine;

a means for retrieving an amount of intake airflow in said storing means on the basis of said area of opening of said throttle valve of said engine and said velocity of said engine to determine a retrieved amount of intake airflow for said area of opening of said throttle valve and said engine velocity, a means for comparing said detected amount of intake airflow with said retrieved amount of intake airflow, an intake airflow modification means which modifies said detected amount of intake airflow based on said change ratio of opening area in said throttle valve, said engine load, and said engine velocity, and a setting means of basic fuel injection amount which sets a basic amount of fuel injection, based on said detected value of said engine velocity and one of said detected amount of intake airflow and said modified amount of intake airflow.

10. The setting device of claim 9, wherein the engine load is determined by the engine velocity and the amount of intake airflow.

* * * * *